US007919152B2

(12) United States Patent
Kritchman et al.

(10) Patent No.: US 7,919,152 B2
(45) Date of Patent: Apr. 5, 2011

(54) METHOD AND APPARATUS FOR CURING WASTE CONTAINING PHOTOPOLYMERIC COMPONENTS

(75) Inventors: Eliahu M. Kritchman, Tel Aviv (IL); Alexander Libinson, Holon (IL); Michael Deriugin, Holon (IL)

(73) Assignee: Objet Geometries Ltd., Rehovot (IL)

( * ) Notice: Subject to any disclaimer, the term of this patent is extended or adjusted under 35 U.S.C. 154(b) by 334 days.

(21) Appl. No.: 12/007,069

(22) Filed: Jan. 7, 2008

(65) Prior Publication Data

US 2009/0176032 A1 Jul. 9, 2009

(51) Int. Cl.

| | |
|---|---|
| ***C08F 2/46*** | (2006.01) |
| ***C08F 2/48*** | (2006.01) |
| ***C02F 1/00*** | (2006.01) |
| ***C02F 1/30*** | (2006.01) |
| ***C02F 1/32*** | (2006.01) |

(52) U.S. Cl. ..... 427/493; 427/457; 427/487; 427/496; 427/508; 427/532; 210/748.01; 210/748.06; 210/749.08; 210/748.1; 210/748.16

(58) Field of Classification Search ..... 427/165, 427/487, 495, 508, 517; 264/401, 494
See application file for complete search history.

(56) References Cited

U.S. PATENT DOCUMENTS

| | | | | |
|---|---|---|---|---|
| 4,786,417 | A * | 11/1988 | Miki et al. | 210/639 |
| 5,308,452 | A | 5/1994 | Marks et al. | |
| 5,505,863 | A | 4/1996 | Danon et al. | |
| 6,096,383 | A * | 8/2000 | Berg et al. | 427/493 |
| 6,850,334 | B1 | 2/2005 | Gothait | |
| 6,902,082 | B2 | 6/2005 | Mabry et al. | |
| 2003/0209836 | A1 * | 11/2003 | Sherwood | 264/401 |

FOREIGN PATENT DOCUMENTS

JP 61114818 * 6/1986

OTHER PUBLICATIONS

Magan et al., Wavelength Dependence of Laser Polymerization of Acrylic Monomers, Polymers of Advanced Technologies, (1991).*
Mcclements, Food Emulsions, CRC Press, (2004).*

* cited by examiner

*Primary Examiner* — Michael Kornakov
*Assistant Examiner* — Lisha Jiang
(74) *Attorney, Agent, or Firm* — Pearl Cohen Zedek Latzer, LLP

(57) ABSTRACT

Method and apparatus for polymerizing photoactive materials included in a liquid material by electromagnetic radiation, by dispensing the liquid material layer-wise into a container and irradiating the accumulated layers by a curing radiation, wherein a substantial part of the radiation is well transmitted through the photoactive material.

13 Claims, 9 Drawing Sheets

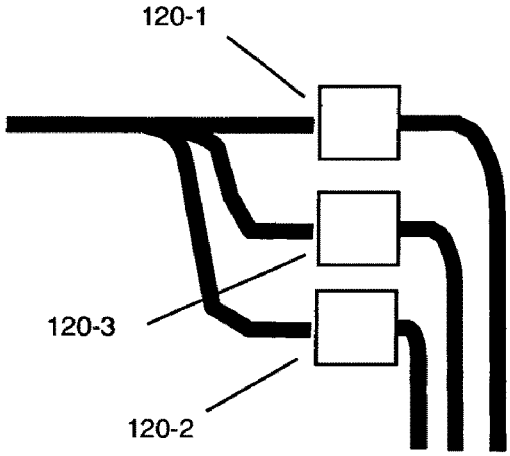
FIG. 8 –A
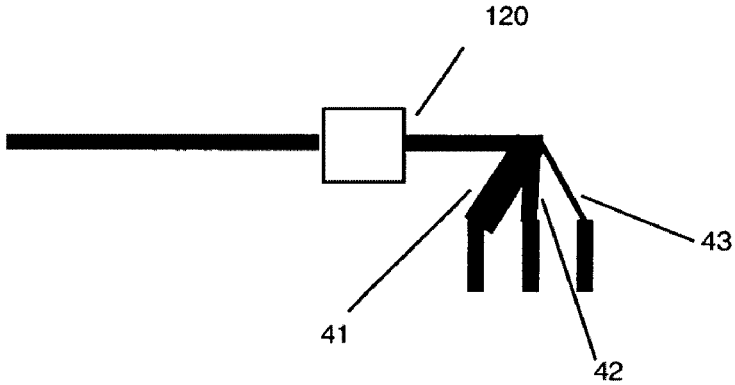
FIG. 8 –B
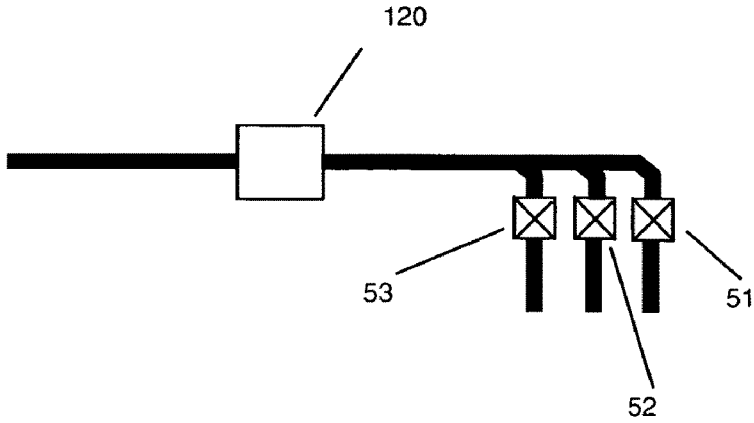
FIG. 8 –C

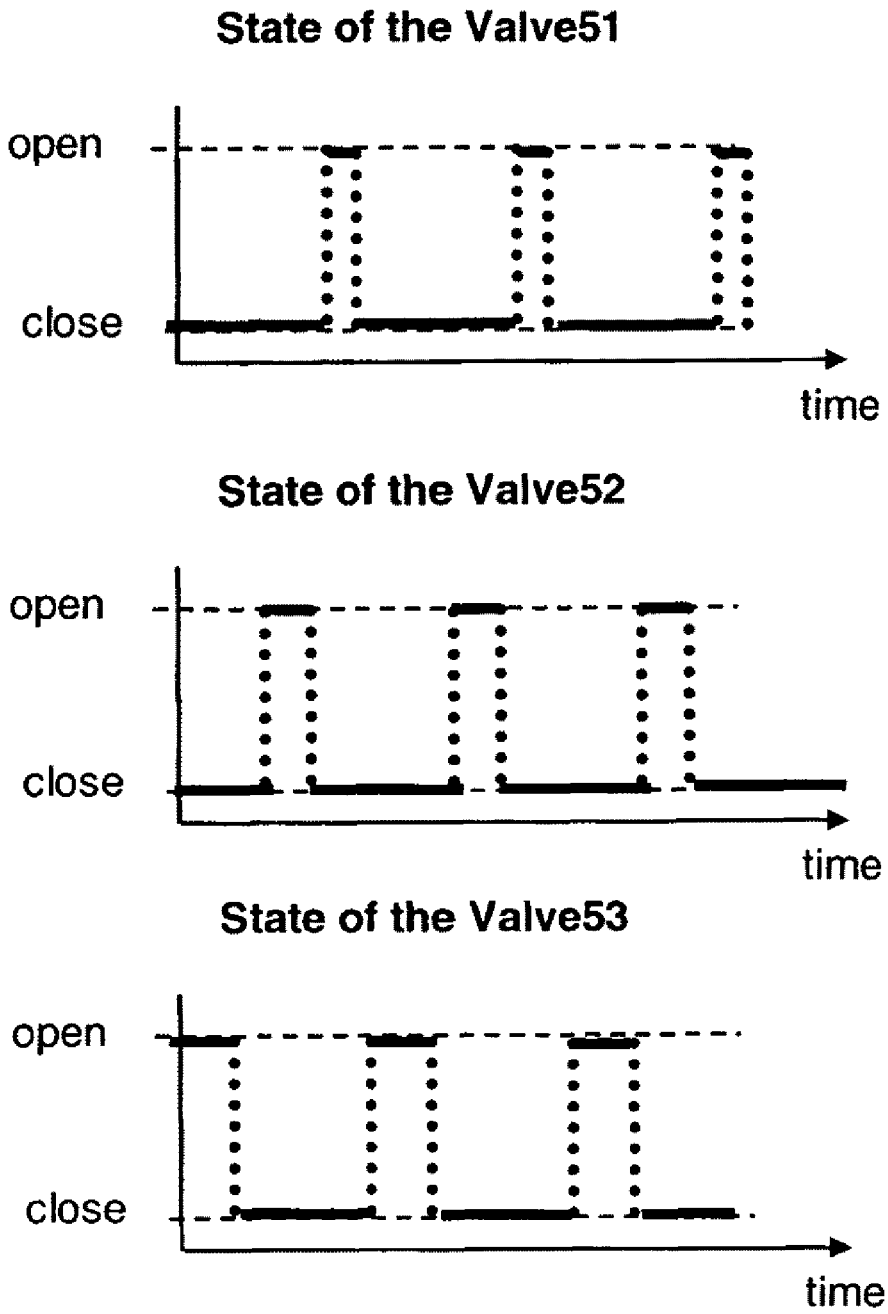
FIG. 8 –D

METHOD AND APPARATUS FOR CURING WASTE CONTAINING PHOTOPOLYMERIC COMPONENTS

FIELD OF INVENTION

The present invention relates to handling of materials containing photopolymeric components in general, and to waste handling in Solid Freeform Fabrication (SFF) in particular.

BACKGROUND OF INVENTION

Many modern technologies employ photopolymer materials. The waste generated by apparatuses used in these technologies may contain partly-polymerized and unpolymerized components, which may be polymerized by radiation (so-called "photoactive" materials). These substances may be toxic or hazardous to the environment in their unpolymerized form and therefore cannot be simply disposed of, e.g. via the regular water drainage system. For this reason, the processing of waste containing photoactive materials is extremely important. The technique below can be used not only for polymerizing waste but also for filling up cavities with polymerized material. An example is cavities in models fabricated by SFF. When such cavities are found to be not appropriate, it is simpler, faster and less costly to fill them with photopolymerizable material, than to fabricate entirely new models.

Most efforts to date have been directed at separating the photoactive components from the rest of the waste content, rendering the latter environmentally safe. The remaining concentrated photo-active components have had to be buried as hazardous chemical substances.

The waste of printing plate machines, for example, includes photopolymers which are washed up with the solvents.

U.S. Pat. No. 5,308,452 to Marks et al. discloses a waste photopolymer plate washout fluid solvent distillation apparatus, including a single enclosure enclosing a waste washout fluid container, a recovered solvent container and a distillation unit in which waste washout is distilled by application of heat and vacuum pressure, and by supplying a metered supply of a surrogate solvent to the distilled waste washout as a desired solvent is distilled from the waste washout. Thus, hazardous and flammable solvent is extracted from the waste, but the state of the photopolymer components is not changed.

U.S. Pat. No. 5,505,863 to Danon et al. discloses a method and apparatus of separating solid particles from waste by use of a centrifugal filter unit. The unit has a collector for the solid material arranged for rotation and disposed so as to allow deposition upon it of solid material during its rotation. The unit is fitted with at least one of a pretreatment unit for coagulating the solid material and a collector removable from the filter unit so as to allow its disposal together with the solid material deposited on it. The unpolymerized components are not treated.

U.S. Pat. No. 6,902,082 to Mabry et al. discloses a modular solvent recovery device which performs distillation of waste photopolymer fluid by application of heat and vacuum pressure for transforming the waste photopolymer into a coalescing concentrated residue. The residue remains photo-active.

U.S. Pat. No. 6,850,334 to Gothait mentions the use of a curing apparatus using ultra-violet or infra-red radiation for disposing of the waste of SFF machines employing photopolymers. However, no details of implementation are provided. The growing use of SFF machines and other industrial processes generating polymerizable waste and the increasing importance of processing such waste to avoid environmental pollution, require a novel solution.

SUMMARY OF INVENTION

In a first aspect of the present invention there is provided a method of polymerizing photoactive components in a liquid material by electromagnetic radiation, the method comprising the steps of: dispensing said liquid material layer-wise into a container from above; and irradiating accumulated layers from above by a curing radiation, wherein said radiation is well transmitted through said liquid material to cure layers of material below the surface. The steps of dispensing and irradiating may be carried out simultaneously.

According to a first embodiment, the radiation is well transmitted through the cured material.

According to a second embodiment, the radiation is incapable of curing the upper layer of material, which may assist in spreading and flattening the liquid material in the container before being cured. The incapability of curing the upper layer may be brought about by inhibition of the curing by oxygen penetration into said upper layer from above.

According to a third embodiment, the liquid material comprises unpolymerizable materials.

According to a fourth embodiment, the upper layer comprises predominantly unpolymerizable materials. The unpolymerizable material in said upper layer may comprise material dispensed in any of the previously dispensed layers, and which has the tendency to accumulate and migrate upwards in the direction of the top of the dispensed material. Alternatively, the upper layer comprising unpolymerizable material may be formed from a quantity of unpolymerizable material which is added at least once to the container in the course of the polymerizing process. We regard "in the course of the polymerizing process" as including immediately before or after the process.

According to a fifth embodiment, the radiation is composed of visible light.

According to a sixth embodiment, at least one of said photoactive components is particularly sensitive to UV radiation.

According to a seventh embodiment, the material is opaque to UV radiation.

According to an eighth embodiment, the radiation power is adjusted low enough to maintain said incapability of curing the upper layer of liquid, yet high enough to maintain curing of lower layers.

According to a ninth embodiment, the dispensed liquid material flows and spreads out before being cured.

According to a tenth embodiment, the last dispensed upper layer in said container is cured by using the following steps: covering the upper layer with a layer of oxygen-blocking substance; and Irradiating the upper layer through said layer of oxygen-blocking substance with a curing radiation. The curing of the last dispensed upper layer may be carried out using the same radiation as used for curing the lower layers. The oxygen-blocking substance may be selected from the group consisting of plastic sheet, water, gas and oil.

According to an eleventh embodiment, the last dispensed upper layer in the container is cured by using a high power source of radiation. The high power source may comprise a flash lamp. The high power source may contain UV radiation.

According to a twelfth embodiment, the liquid material is a waste material.

In a second aspect of the present invention there is provided an apparatus for polymerizing photoactive components in a liquid material, comprising: a container; means for dispensing the liquid material into said container; at least one radiation source emitting radiation which is well transmitted through said liquid material to cure layers of material below the surface; and electronic control means connected with said dispensing means and said radiation means.

According to a first embodiment, the apparatus further comprises spreading means, connected with said control means, for layer-wise spreading of the liquid material in the container, said spreading means comprising at least one of means for rotating said container and means for moving said dispensing means. The spreading means may comprise at least one nozzle for dispensing said liquid material.

According to a second embodiment, the at least one nozzle comprises a plurality of nozzles. Each nozzle of said plurality of nozzles has a different flow rate.

According to a third embodiment, the apparatus comprises means for varying at least one of the power and the spectral properties of said radiation source.

According to a fourth embodiment, the apparatus comprises means for varying the distance between said radiation source and said container.

According to a fifth embodiment, the apparatus comprises means for covering the upper surface of the last dispensed layer of said liquid material with an oxygen-blocking substance and means for irradiating said upper layer through said oxygen-blocking substance. The oxygen-blocking substance may be selected from the group consisting of plastic sheet, water, gas and oil.

According to a sixth embodiment, the means for irradiating the upper layer comprises a high power radiation source. The high power radiation source may comprise a flash lamp. The high power radiation source may contain UV radiation.

According to a seventh embodiment, the at least one radiation source emits radiation incapable of curing the upper layer of the material.

According to an eighth embodiment, the at least one radiation source emits radiation which is well transmitted through the cured material.

According to a ninth embodiment, the liquid material comprises unpolymerizable materials.

According to a tenth embodiment, the upper layer comprises predominantly unpolymerizable materials.

According to an eleventh embodiment, the means for dispensing and said means for spreading are adapted to operate simultaneously and continuously.

According to a twelfth embodiment, the radiation source emits visible light.

According to a thirteenth embodiment, at least one of said photoactive components is particularly sensitive to UV radiation.

According to a fourteenth embodiment, the liquid material is opaque to UV radiation.

According to a fifteenth embodiment, the liquid material is a waste material.

BRIEF DESCRIPTION OF THE DRAWINGS

For better understanding of the invention and to show how the same may be put into effect, reference will now be made, purely by way of example, to the accompanying drawings.

It is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the accompanying drawings:

FIG. 1 is a graph showing the radiation absorption of liquid and cured material according to the present invention, in the relevant UV spectral range;

FIG. 2 is a graph showing the dependence of material curability on depth in the presence of oxygen;

FIG. 3 is a graph depicting the dependence of curability on radiation wavelength;

FIG. 4 is a graph depicting the penetration of radiation of different wavelengths into the photopolymer as a function of the distance traveled within the material;

FIG. 5 is a schematic drawing of an exemplary apparatus for implementing the method according to an embodiment of the present invention;

FIG. 6 is a graph showing the spectral distribution of lamp radiation according to an embodiment of the present invention;

FIG. 7 is a schematic drawing of an exemplary apparatus for implementing the method according to another embodiment of the present invention; and FIGS. 8A-D show different implementations of means for appropriate distribution of the general flow of material between nozzles, according to an embodiment of the present invention.

DETAILED DESCRIPTION OF PREFERRED EMBODIMENTS

Figure 1:
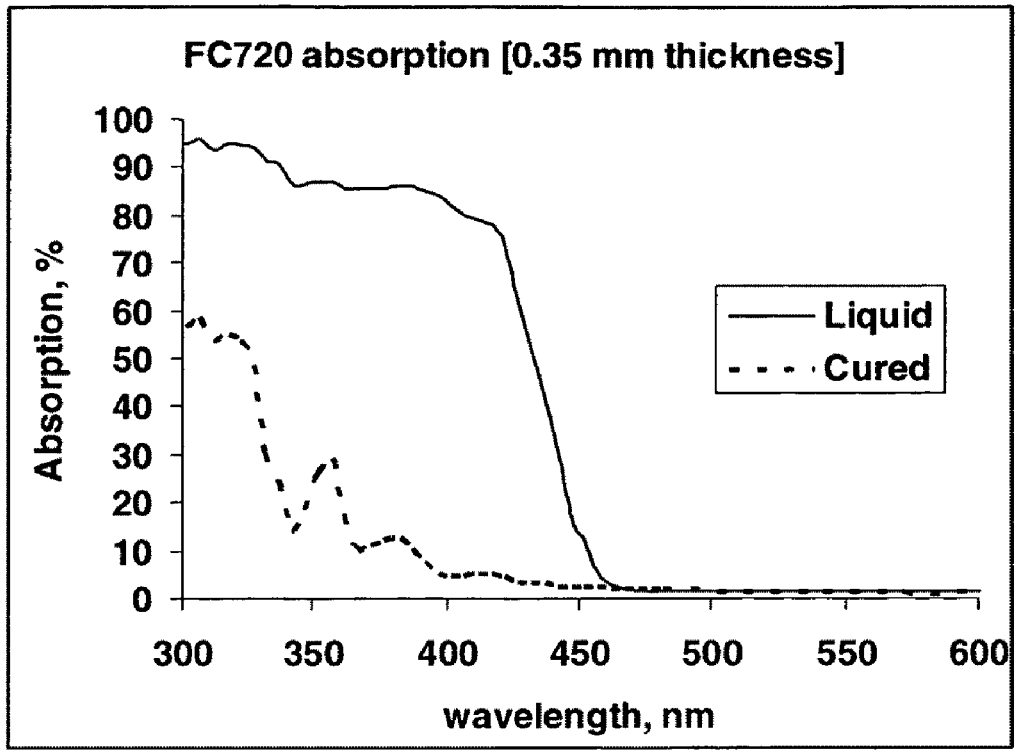

Throughout this document the terms curable, photo-curable, photo-active and photopolymerizable are deemed synonymous.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

The present invention describes a method of complete curing of photo-curable waste. In one embodiment the waste is generated by SFF machines employing UV-photopolymerizable materials. An example of such material is FullCure® 720, provided by Objet Geometries Ltd., a photopolymerizable material which is particularly sensitive to UV radiation. When cured, the material comprises only a low content of photoactive components, and therefore processed (cured) waste may be disposed of as common trash. The invention additionally includes an apparatus for performing the method.

In one embodiment in the field of SFF, photopolymerization of the materials is brought about by UV radiation with a wavelength of 300-400 nm. FIG. 1 shows the absorption capacity of the liquid and cured material in this spectral range. As shown, the cured material transmits UV much better than the uncured materials.

For this reason, when curing of the surface layer is completed, the UV radiation penetrates deeper into the material, resulting in the polymerization of the sub-surface volume.

Figure 2:
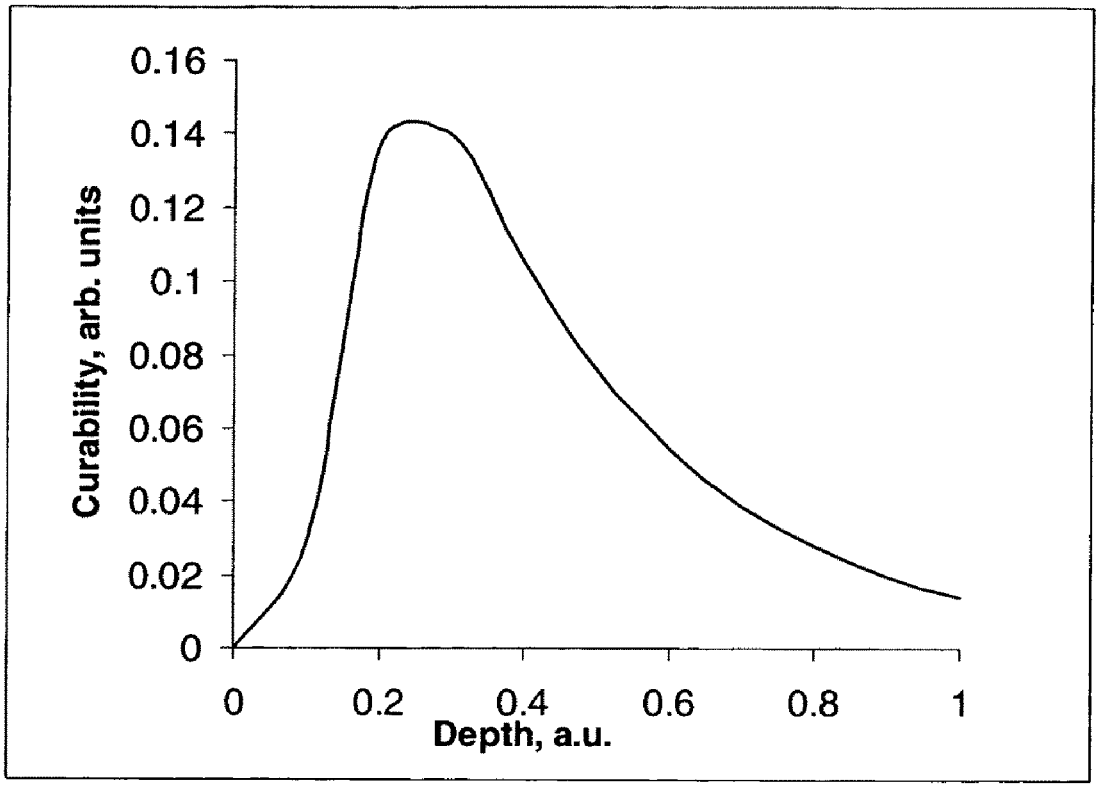

Photopolymerization is known to be inhibited by oxygen absorbed by the photopolymer. Under normal conditions, oxygen from the atmosphere diffuses into the uncured photopolymer to a depth of several tenths of a micrometer. Therefore, photopolymerization of this very thin layer requires very high-powered sources of radiation, or the use of special techniques to overcome the oxygen inhibition. FIG. 2 illustrates the dependence of material curability on depth of radiation in the presence of oxygen. The graph takes into account the lessening of radiation in deeper layers as a result of radiation absorption.

Figure 3:
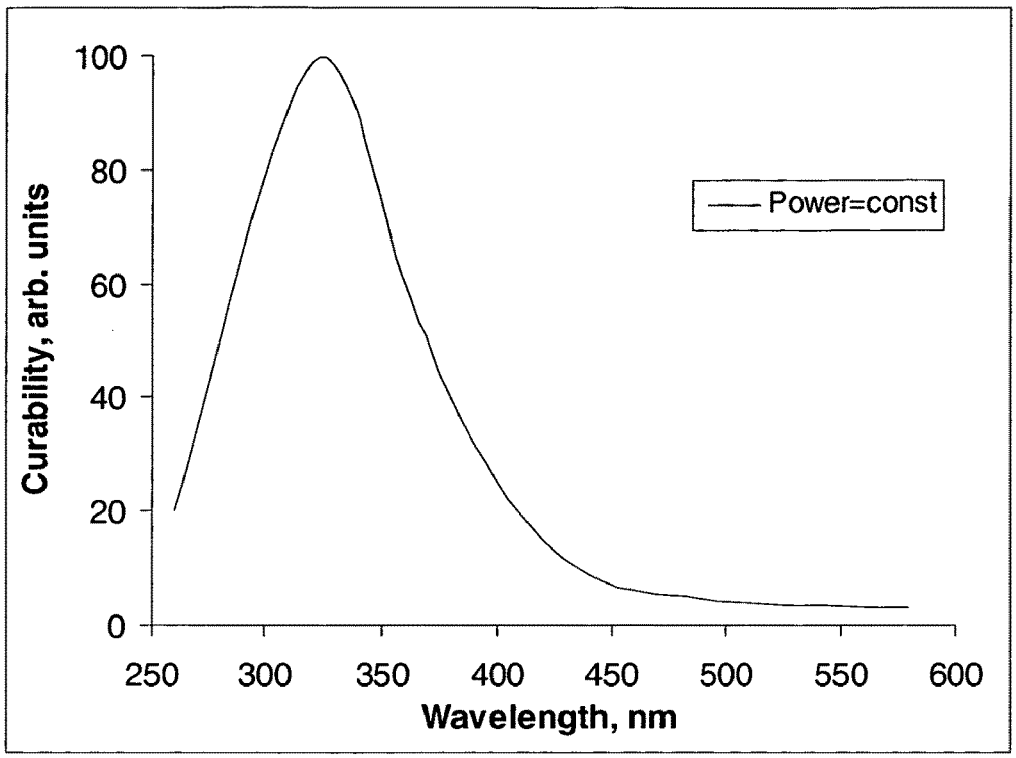
Figure 4:
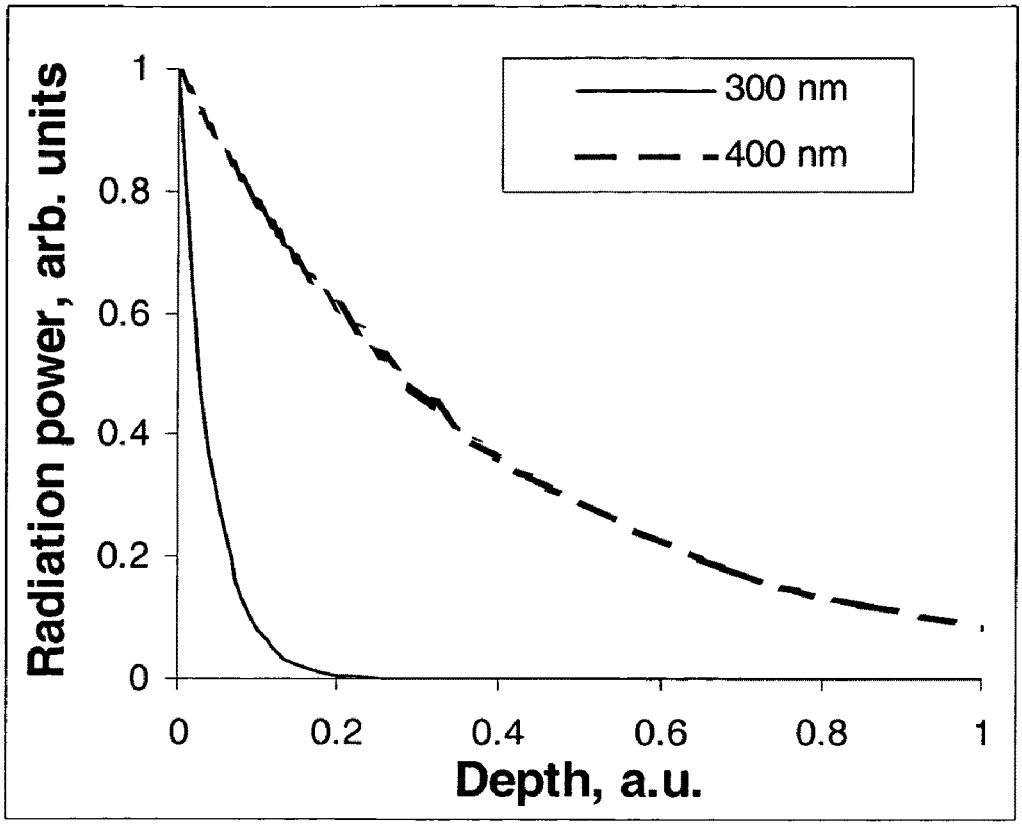

Photopolymerization is initiated by the activation of a photoinitator by radiation. As shown in FIG. 3, this process has the highest yield at a comparatively short wavelength (e.g., 320 nm). Radiation of such short wavelength is absorbed into the very thin surface using relatively low radiation power, as shown in FIG. 4, depicting penetration of radiation of the different wavelengths into the photopolymer as a function of the distance traveled within the material. This surface layer has approximately the same thickness as the oxygen penetration depth. Because of the oxygen inhibition effect described above, the overall efficiency of short wavelength radiation at moderate power is poor. Long-wavelength radiation, having a lower photoinitiator activation yield (see FIG. 3), penetrates much deeper into the photopolymer (FIG. 4), reaching the sub-surface area with low oxygen content and providing better overall polymerization.

The radiation power or exposure time must be increased in order to compensate for the poor curability of the long-wave radiation. For technical reasons, use of high power illuminators may be more difficult and costly. The oxygen inhibition phenomenon prevents polymerization of the thin surface, but for the bulk of the photopolymer the only important quantity is the total absorbed energy. Thus, exposure time and radiation power are interchangeable, as can be seen from Table 1 below.

TABLE 1

Thickness of the polymerized materials for different radiation power levels at the same density of radiation energy (4.3 kJ/cm$^2$).

| Radiation power, W | Exposure, min | Polymerized thickness, mm |
|---|---|---|
| 8 | 9 | 7.3 ± 2.5 |
| 4 | 18 | 8 ± 2.5 |
| 12 | 6 | 7.5 ± 2.5 |

It is proposed that the waste be cured with electromagnetic radiation of a wide spectrum range, including visible light and near ultra-violet. The short-wave component polymerizes the layers near the surface, e.g. the layers from 0.5 mm below the upper surface to 1 mm below the upper surface, preventing further diffusion of the oxygen into the bulk of the polymerizable material. The long-wave component penetrates deeper beneath the outer surface and polymerizes the bulk of the material.

According to a preferred embodiment of the present invention, the waste material is continuously fed into a curing vessel during the curing process, and laid therein in layers, as described herein. The rate of feeding of the waste into the curing vessel is selected within the limits that make feasible use of a radiation source of moderate power. The radiation penetrates a certain depth into the unpolymerized materials. If the liquid unpolymerized waste were spread in a thicker layer, the deeper part of the layer would remain unpolymerized. In order to ensure good/optimal spontaneous spreading of the waste fluid, the radiation power used should not be too high, otherwise it would rapidly polymerize the thin outer layer and therefore significantly decrease its fluidity. The rate of waste supply should likewise not be too high, in order to maintain the thickness of the unpolymerized layer below penetration depth of the radiation.

Since the radiation source of the present embodiment is located above the curing vessel, the upper layer of the material is the closest to it. This layer receives the most powerful radiation and may polymerize immediately, decreasing fluidity of the entire layer, impeding lateral spreading of the waste and possibly causing significant non-uniformity of the thickness of the cured waste. In order to avoid this, the main process of polymerization is performed in an air atmosphere, i.e. the deposited material is exposed to the air within the container. As discussed above, oxygen contained in the air is known to inhibit photopolymerization if the radiation power does not exceed a certain threshold, depending on the photopolymer composition. For example, for Objet's FullCure® 720 material, this threshold is approximately 10 W/cm$^2$. The radiation level used in the present invention should meet this requirement. Thus, at the end of the process, when all the material has been spread and cured, only a thin surface layer remains unpolymerized and has to be treated in a special manner as described below.

The container used for the photopolymerization process should conform very well to the polymerized material, i.e. the walls and bottom of the vessel in particular must constantly be in very close contact with the polymerized material. This requires that the vessel be made of a material (e.g., polyamide, 1-2 mm thickness) which enables expansion and contraction of the vessel's walls during polymerization of its content, to prevent yet unpolymerized material from leaking through gap(s) between the polymerized material and the vessel's walls, whereby the unpolymerized material would disadvantageously be shielded from the radiation source.

As each layer of the material is fed into the vessel, it is continuously exposed to oxygen from the air above the layer, which prevents polymerization of the layer at moderate light intensity. This same layer is later polymerized, when covered by a subsequent layer, which acts as a barrier to the oxygen from above. In order to complete polymerization of the waste, i.e. to cure the last deposited layer, we propose introducing an oxygen diffusion barrier.

The barrier layer may be formed by unpolymerizable material which has a tendency to migrate upwards towards the top of the dispensed material. In some cases the unpolymerizable material may be a component of the liquid waste (for example in FullCure® 705 support material (Object Geometries Ltd.) discussed herein). In other cases, the unpolymerizable material may be added to the container intentionally. This should be done at least once in the course of the curing process. We regard "in the course of the polymerizing process" as including immediately before or after the process. In a specific embodiment, it may be done once, after completion of dispensing.

Alternatively, the barrier layer may consist of a thin transparent polymer (e.g., nylon) which is applied to the surface of the topmost layer after waste dispensing is complete.

In an alternative embodiment, the barrier layer may consist of oil or water.

Another method of preventing oxygen inhibition of photopolymerization is the use of a protective 'atmosphere'. This may be in the form of an inert gas (e.g., nitrogen or carbon dioxide) substituting oxygen-containing air near the polymerized material.

Another possibility for completing polymerization of the waste, i.e. to cure the last deposited thin top layer, is the use of strong pulse radiation.

Figure 5:
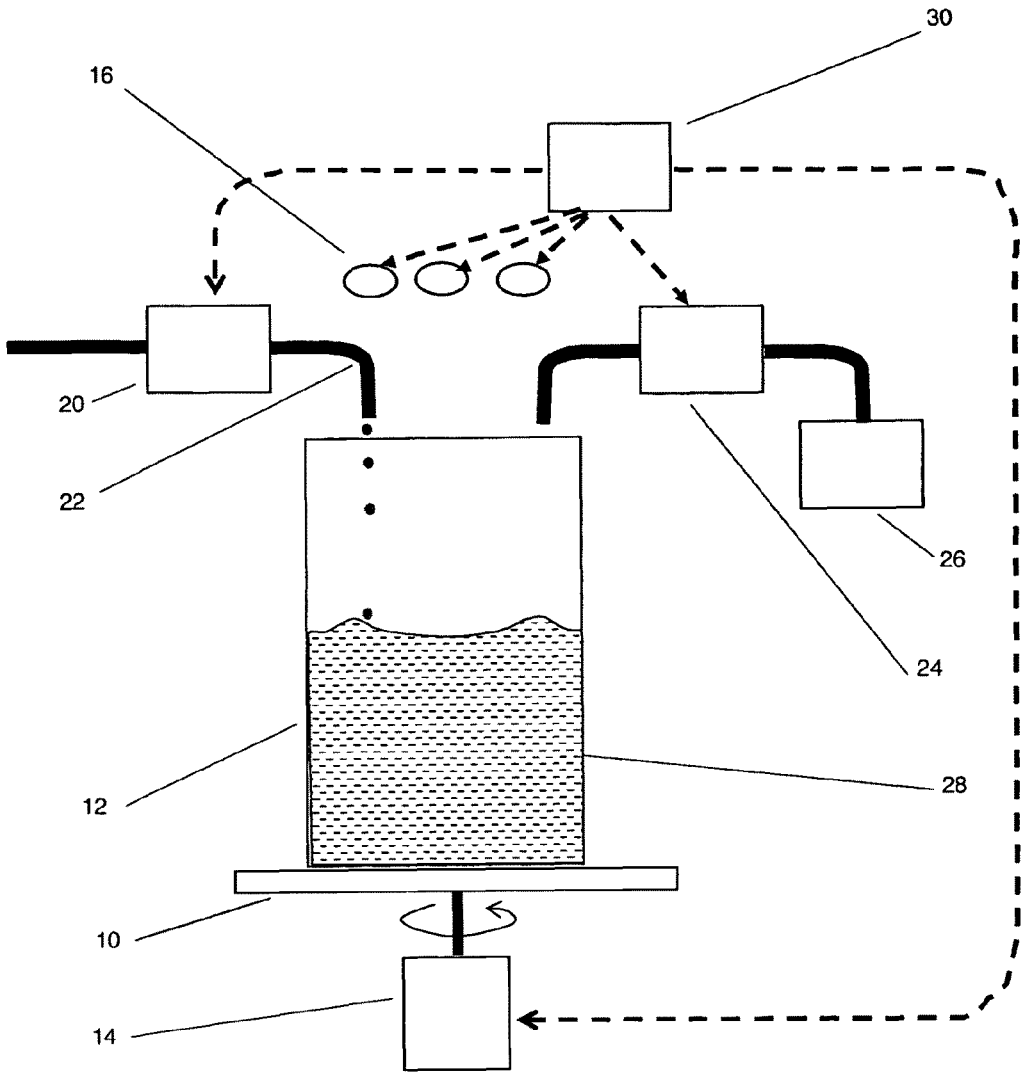

FIG. 5 is a schematic drawing of an exemplary apparatus for implementing the methods of the present invention, including the following main components:

A container or 'curing vessel' (12) into which unpolymerized fluid waste is deposited and within which polymerization occurs;

Means (20, 22) for feeding the unpolymerized material into the container;

At least one source of illumination (16); and

Means (24) for polymerizing the uppermost layer.

The apparatus may include means for uniform spreading of the deposited unpolymerized material.

According to one embodiment of the present invention, container (12) (e.g. 30 cm diameter, 15 cm height) is placed on a platform (10), which is rotated by a motor (14) at a speed of 3 to 10 rpm. Motor (14) may be any electrical motor providing the required speed, such as Buhler 29014007 24V/30 with the gear 86-03-18 of SBS Feintechnik. Three fluorescent lamps (16) of 48 W power each, for example of the "cool light" type, are mounted at a distance of 5 to 10 cm above the top edge of the container. The lamps may for example be OSRAM 24 W/840 or PHILIPS PL-L 24 W841 lamps. The unpolymerized material is fed into the container by at least one pump (20) with a flow rate of 5 to 20 ml/min and deposited via a single nozzle (22). After the bulk of the waste has been polymerized, leaving only a thin unpolymerized top layer, water is supplied by a water pump (24) from a water reservoir (26), for curing the uncured last (topmost) layer covering the polymerized waste material (28). A main controller (30), such as MITSUBISHI AL-10MR-D, controls rotation of the platform, deposition of the waste material, the performance of the curing process steps in the appropriate order and curing of the topmost layer.

Figure 6:
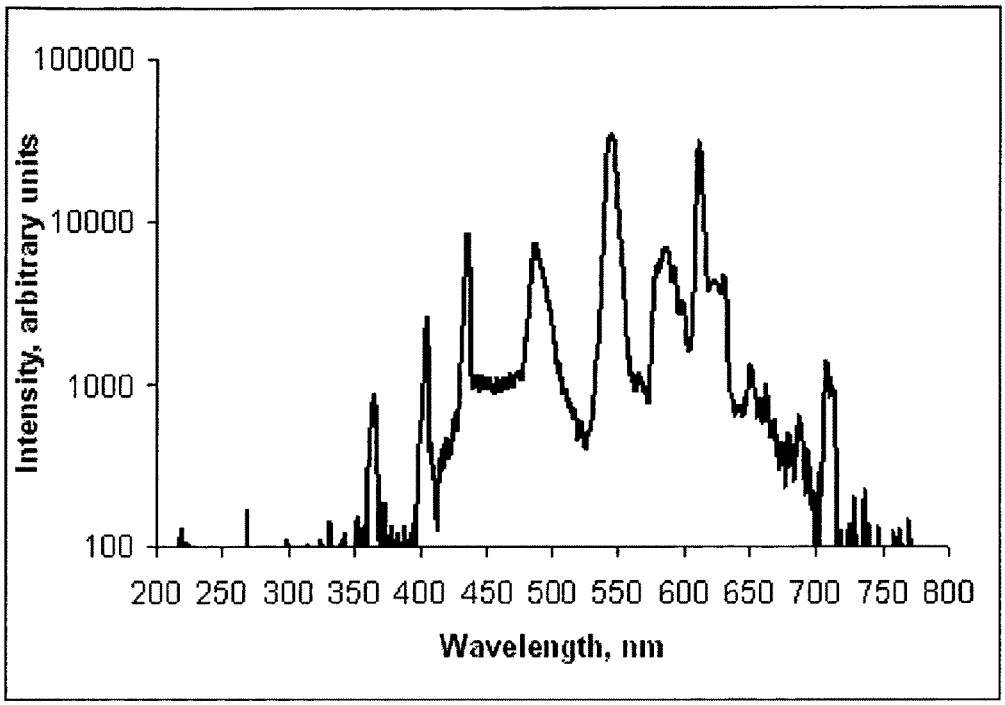

The spectral distribution of the lamps used in this embodiment is shown in FIG. 6. It may be seen that it contains both short-wavelength and long-wavelength components, providing for surface and bulk polymerization, respectively.

The embodiment described above was tested for polymerization of waste from an Eden™ 500 machine provided by Objet Geometries Ltd. The waste consisted of equal quantities of modeling and support materials (FullCure® 720 and FullCure® 705, respectively) and contained more than 70% weight of photo-active (unpolymerized) material. After curing according to the methods described herein, the polymerized waste contained 0.06% weight of unpolymerized material. Practically, this shows that the proposed method and apparatus provide full curing of waste which may then be disposed of as office trash.

The same embodiment was successfully tested for curing waste consisting of pure FullCure® 870 material (Objet Geometries Ltd.) which is highly opaque with respect to UV penetration of more than 0.4 mm.

Figure 7:
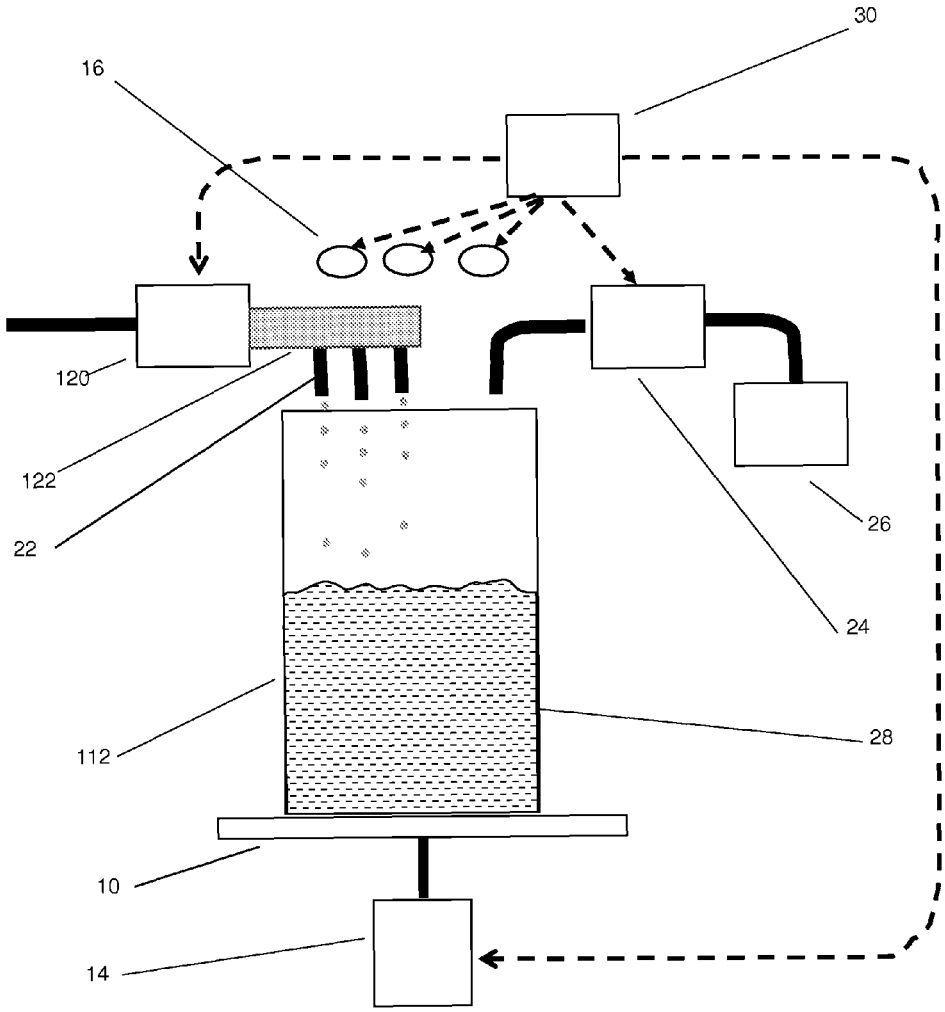

In a second embodiment of the present invention, as depicted in FIG. 7, for curing waste materials with high viscosity, additional means for thin-layer forming are necessary. The corresponding embodiment includes a set of 3 nozzles (122) located at radial distances of 0.2, 0.5 and 0.8 respectively from the rotation axis of the container (112), instead of the single nozzle (22) of the first embodiment. Each nozzle (22) of the set of nozzles (122) has an optimal flow value which decreases with the increase in its radial distance from the rotation axis of the container. Appropriate distribution of the general flow may be performed by:

a) using separate pumps for each nozzle (not shown) with controlled productivity; or b) using a single pump (120) with controlled distribution flow between nozzles (e.g., with electrical valves and timed feeding of each nozzle, or using parallel pipes of different hydrodynamic impedance providing the required ratio of flow via the nozzles).

Three different implementations of means for appropriate distribution of the general flow between nozzles are depicted in FIG. 8. In all the implementations, distribution between three nozzles is presented by way of example.

FIG. 8A shows three separate pumps (120-1, 120-2 and 120-3). The flow rate of each nozzle (122) is set by the productivity of its corresponding pump.

FIG. 8B shows a single pump (120) whose feeding tube is split into 3 separate pipes (41, 42 and 43), each having a different hydrodynamic impedance. Each pipe is connected to its respective nozzle. The flow rate of each nozzle is determined by the hydrodynamic impedance of the connected pipe. The hydrodynamic impedance of the pipe increases with a decrease in the pipe's internal diameter and with an increase in its length. In this example, different internal pipe diameters are used in order to obtain different hydrodynamic impedances. In other implementations, the pipes may have the same internal diameter, but different lengths.

In FIG. 8C, a single pump (120) is used, with electrically controlled valves (51, 52 and 53). Each valve is connected to a single nozzle. The flow rate of the nozzle is determined by the duty cycle of opening the corresponding valve. An example of time varied control of the different valves is shown in FIG. 8D. From the diagram showing various valve states, one can see that valve (51) is open for the briefest time interval and valve (53) is opened for the longest. This means that the flow rate of the nozzle connected to valve (51) is the lowest, and the flow rate of the nozzle connected to valve (53) is the highest. The flow rate of the nozzles may be altered in order to attain desired values, by adjustment of the open state duty cycles of the valves. In a preferred embodiment, no two valves are open simultaneously.

In another embodiment, a single nozzle may be used, with additional means for lateral (linear) motion with a pre-defined change of velocity according to its radial position. In this embodiment, if the nozzle is near the periphery of the vessel, its lateral speed should be low enough for the waste material to spread over the circle of the widest possible radius. When the nozzle is near the center of the vessel, the material spreads over a smaller circular area, so the lateral speed of the nozzle should be high.

The parameters of the waste (e.g., its transparency, viscosity etc.) may depend on the printing materials used (i.e. on the components of the material). In order to provide for different materials, the radiation may be altered according to the properties of the waste material. This alteration may be:

a) according to a pre-defined process table, providing the required parameters of radiation for each printing material or combination of materials used; or b) adaptive, e.g. according to the instant measured polymerization degree of the waste.

The spectral distribution of power and/or the total power of radiation in this case are subject to control. One embodiment includes radiation source(s) with controllable spectral distribution and/or total emitted power, such as two luminescent lamps: one with very short wave radiation (e.g. G8T5E of USHIO, with central wavelength 306 nm), and the second with longer-wave radiation (e.g. F8T5BL of USHIO, with central wavelength 352 nm), a controller, means for storing the decision table for case (a) or means for monitoring the polymerization degree of the waste (e.g. measuring content of the monomer present in the air above the vessel) and a decision algorithm for case (b).

Depending on the shape of the vessel and dimensions of the sources of radiation, the radiation power on the surface of the polymerized fluid may depend strongly on the distance between the fluid level and the radiation sources. Because the fluid level changes as the vessel fills, in order to maintain a constant radiation power on the fluid surface, it may be preferable to change the height of the radiation source with respect to the vessel, rather than to change the source's power.

In some cases, use of water for curing the top layer may not be desirable. Alternative curing methods may be used, for example:

a) employing a flash-lamp with high instant power;
b) employing protective gas atmosphere;
c) employing protective condensed film transparent in the visible and UV ranges (e.g., nylon of 0.05 mm thickness); or
d) employing a layer of oil, transparent within the visible and UV ranges.

The corresponding embodiments include a flash-lamp with the appropriate control circuits, such as L6605 (of Hamamatzu) for case (a), means for filling lamp-waste gap with oxygen-less atmosphere (e.g., nitrogen or carbon dioxide) for case (b), by controllable leaking of the pressurized gas from an industrial high-pressure vessel equipped with a valve and a regulator, or means for covering the waste surface with an appropriate thin film, providing tight contact with the entire waste surface area for case (c) e.g., by tight manual placement of the thin film.

The commonly used support material FullCure® 705 (Object Geometries Ltd.), contains unpolymerizable components to aid in its easy removal after building of a model has been completed. This is an example of generation of waste containing unpolymerizable components. During waste curing, these components separate from the polymerized material and have the tendency to accumulate and migrate upward in the direction of the top of the material. Eventually they form a liquid film covering the upper surface of the waste. The liquid film is usually thin enough to transmit a significant fraction of UV radiation. The oxygen solubility in these materials is low; therefore the liquid film protects the waste from oxygen penetration. In this case top layer curing does not require a special treatment.

It is appreciated that certain features of the invention, which, for clarity, are described in the context of separate embodiments, may also be provided in combination in a single embodiment. Conversely, various features of the invention which, for brevity, are described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof which would occur to persons skilled in the art upon reading the foregoing description.

What is claimed:

1. A method of polymerizing photoactive components in a liquid material by electromagnetic radiation, the method comprising:

continuously dispensing said liquid material into a container from above;

adjusting radiation power of a radiation source located above the container to be incapable of curing a top surface of said liquid material;

and simultaneously while dispensing, continuously irradiating said liquid material within the container from the radiation source at the radiation power such that a curing radiation is transmitted through the uncured surface into said liquid material to cure the liquid material below the surface.

2. The method of claim 1, wherein maintaining the surface at a liquid state assists in spreading and flattening of the liquid material in the container before being cured.

3. The method of claim 1, wherein the radiation is composed of visible light.

4. A method according to claim 1, wherein said radiation source is a fluorescent lamp.

5. The method of claim 1, wherein at least one of said photoactive component is sensitive to UV radiation.

6. The method of claim 1, wherein an upper portion of said liquid material in said container is cured by:

covering the upper portion with a layer of oxygen-blocking substance; and irradiating from said radiation source through said layer of oxygen-blocking substance to cure the upper portion of said liquid material.

7. The method of claim 6, wherein curing of the upper portion is carried out using the same radiation power as used for curing the liquid material beneath the surface.

8. The method of claim 6, wherein said oxygen-blocking substance is selected from the group consisting of plastic sheet, water, gas and oil.

9. The method of claim 1, wherein the upper portion comprises previously dispensed unpolymerizable material that migrated upwards in the direction of the top surface.

10. The method of claim 1, wherein the upper portion comprises unpolymerizable material that was further added at least once to the container in the course of the dispensing and irradiating process.

11. The method of claim 1, wherein an upper portion of liquid material within the container is cured by using a high power radiation source.

12. The method of claim 11, wherein said high power source contains UV radiation.

13. The method of claim 1, wherein said liquid material is a waste material.

* * * * *